US009655427B2

(12) United States Patent
Cui

(10) Patent No.: US 9,655,427 B2
(45) Date of Patent: May 23, 2017

(54) VAPOR BEAUTIFYING AND HAIR CONDITIONING MACHINE

(71) Applicant: Zhe Cui, Guangdong (CN)

(72) Inventor: Zhe Cui, Guangdong (CN)

( * ) Notice: Subject to any disclaimer, the term of this patent is extended or adjusted under 35 U.S.C. 154(b) by 0 days.

(21) Appl. No.: 14/851,334

(22) Filed: Sep. 11, 2015

(65) Prior Publication Data

US 2016/0073758 A1 Mar. 17, 2016

(30) Foreign Application Priority Data

Sep. 11, 2014 (CN) ..... 2014 2 0522623 U

(51) Int. Cl.
*A45D 19/16* (2006.01)
*F22B 1/28* (2006.01)

(52) U.S. Cl.
CPC ..... *A45D 19/16* (2013.01); *F22B 1/282* (2013.01)

(58) Field of Classification Search
CPC ..... F26B 19/00; F26B 21/00; F26B 23/00; A45D 20/00; A45D 20/12; A45D 19/16; F22B 1/122
USPC ..... 34/96, 97, 98, 99, 100
See application file for complete search history.

(56) References Cited

U.S. PATENT DOCUMENTS 1,504,149 A * 8/1924 Ruffio ..... A45D 20/44 34/99
2,474,427 A * 6/1949 Kending ..... A45D 20/44 34/99
2,576,226 A * 11/1951 Huber ..... A45D 20/18 34/82
3,238,639 A * 3/1966 Descarries ..... A45D 20/44 34/99
3,393,676 A * 7/1968 Kummer ..... A61C 1/00 128/200.19
3,911,934 A * 10/1975 Helbling ..... A45D 20/52 132/271
5,444,215 A * 8/1995 Bauer ..... A45D 20/50 132/212
5,568,691 A * 10/1996 Rubin ..... A45D 20/16 34/98
5,926,972 A * 7/1999 Di Peso ..... A01K 13/001 34/128

(Continued)

FOREIGN PATENT DOCUMENTS

CN WO 2016037402 A1 * 3/2016 ..... F22B 1/282
CN EP 2995216 A3 * 4/2016 ..... F22B 1/282

(Continued)

*Primary Examiner* — Stephen M Gravini
(74) *Attorney, Agent, or Firm* — Rankin, Hill & Clark LLP

(57) ABSTRACT

The present application is used in the technical field of beautifying and hair conditioning, and provides a vapor beautifying and hair conditioning machine comprising a main machine and an ejection gun; wherein, the ejection gun is communicated with the main machine via a hose, the main machine is provided with a socket, and one end of the hose is provided with a plug that is capable of being inserted in the socket; the socket is provided therein with a hose connector male end and a latching groove, the plug is provided therein with a hose connector female end and a latching member, and the hose connector male end and the hose connector female end engage with each other; when the plug is inserted in the socket, the latching member is inserted and held in the latching groove.

8 Claims, 4 Drawing Sheets

(56) References Cited

U.S. PATENT DOCUMENTS

| | | | | |
|---|---|---|---|---|
| 6,655,656 | B2 * | 12/2003 | Maldavs | F16L 37/23 137/614 |
| 7,331,542 | B2 * | 2/2008 | Cocciadiferro | B65H 19/10 242/578 |
| 7,472,455 | B2 * | 1/2009 | Dolton | A45D 44/04 15/323 |
| 8,544,689 | B2 * | 10/2013 | Bertram | B29B 7/7438 222/145.6 |
| 2003/0080220 | A1 * | 5/2003 | Mather | B05B 1/04 239/690 |
| 2016/0022004 | A1 * | 1/2016 | Johnson | A45D 20/525 132/112 |
| 2016/0073758 | A1 * | 3/2016 | Cui | A45D 19/16 132/272 |
| 2016/0081458 | A1 * | 3/2016 | Sullivan | A45D 44/06 361/679.01 |
| 2016/0150864 | A1 * | 6/2016 | Thomason | A45D 20/12 34/283 |
| 2016/0279661 | A1 * | 9/2016 | Tanaka | B05C 11/10 |

FOREIGN PATENT DOCUMENTS

| | | | | |
|---|---|---|---|---|
| DE | 4227829 | A1 * | 6/1993 | A45D 20/10 |
| MY | WO 2011005070 | A1 * | 1/2011 | H01R 11/11 |

* cited by examiner

VAPOR BEAUTIFYING AND HAIR CONDITIONING MACHINE

FIELD OF THE INVENTION

The present application relates to the technical field of beautifying and hair conditioning, and more particularly to a vapor beautifying and hair conditioning machine

BACKGROUND OF THE INVENTION

A main machine of a vapor beautifying and hair conditioning machine is generally provided therein with a water tank, water in the water tank can flow into a boiler in an ejection gun via a hose, the boiler in the ejection gun can heat the water and thereby transform the water into vapor, and the vapor can be ejected via an exit of the ejection gun. In a conventional vapor beautifying and hair conditioning machine, the ejection gun is usually fixedly connected with the main machine, which is inconvenient for the ejection gun or the main machine to be updated or upgraded independently. At the same time, during the process of using the vapor beautifying and hair conditioning machine, if the hose is wound, the ejection gun may need to be rotated correspondingly so that the hose is restored; however, this operation is complicated.

SUMMARY OF THE INVENTION

The technical problem to be solved by the present application is to provide a vapor beautifying and hair conditioning machine, which is used to solve the problem that a vapor beautifying and hair conditioning machine in the prior art is inconvenient for its ejection gun or main machine to be updated or upgraded independently and has a hose which is difficult to be restored after being wound.

The present application is realized by the following technical solution: a vapor beautifying and hair conditioning machine comprising a main machine and an ejection gun; wherein, the ejection gun is communicated with the main machine via a hose, the main machine is provided with a socket, and one end of the hose is provided with a plug that is capable of being inserted in the socket; the socket is provided therein with a hose connector male end and a latching groove, the plug is provided therein with a hose connector female end and a latching member, and the hose connector male end and the hose connector female end engage with each other; when the plug is inserted in the socket, the latching member is inserted and held in the latching groove.

Furthermore, the socket is further provided therein with a power connector male end, and the plug is further provided therein with a power connector female end; when the plug is inserted in the socket, the power connector male end is electrically connected with the power connector female end.

Furthermore, the socket further includes a top cover and a bottom cover, the latching groove is defined in the top cover, the top cover and the bottom cover are combined together to define a containing groove, and the plug can be inserted in the containing groove.

Furthermore, the socket further includes a protecting cover, the protecting cover is hinged on the top cover of the socket, and is near to the opening of the containing groove.

Furthermore, the plug further includes a top cover and a bottom cover, the top cover and the bottom cover are combined together, the top cover defines an assembling hole, and the latching member is mounted in the assembling hole.

Furthermore, the hose connector female end is fixed on the bottom cover of the plug.

Furthermore, the latching member includes a pressing part, a latching part, and a supporting part; the pressing part protrudes out from the assembling hole, and the supporting part supports the hose connector female end; when the plug is inserted in the socket, the latching part is inserted and held in the latching groove; and when the plug leaves the socket, the latching part leaves the latching groove.

Furthermore, a periphery of the hose connector female end is provided with a first flange and a second flange that are spaced from each other, an end of the latching member that is away from the pressing part abuts against the first flange, and the supporting part abuts against the second flange.

Compared with the prior art, the present application has the following advantageous effects: in the present application, by means of reciprocal connection or separation between the latching member in the plug and the latching groove in the socket, detachable connection between the ejection gun and the main machine is realized. At the same time, the hose connector male end and the hose connector female end engage with each other, which ensures that water in the main machine can flow into the ejection gun and does not leak when the plug is inserted in the socket. When the main machine or the ejection gun needs to be updated or upgraded independently, or when the hose is wound during the use of the vapor beautifying and hair conditioning machine, the latching relation between the latching member and the latching groove is released, and the plug is pulled out from the socket, so that the ejection gun is separated from the main machine and thus the vapor beautifying and hair conditioning machine is detached into two parts. In this way, it is convenient to update or upgrade the main machine or the ejection gun, and is also convenient to restore the wound hose.

DETAILED DESCRIPTION OF THE PREFERRED EMBODIMENT

In order to make the technical problems to be solved by the present application, the technical solutions of the present application, and the advantages of the present application be clearer, the present application will be further described hereafter with reference to the accompany drawings and embodiments. It should be understood that the embodiments described herein are only intended to illustrate but not to limit the present application.

Figure 1:
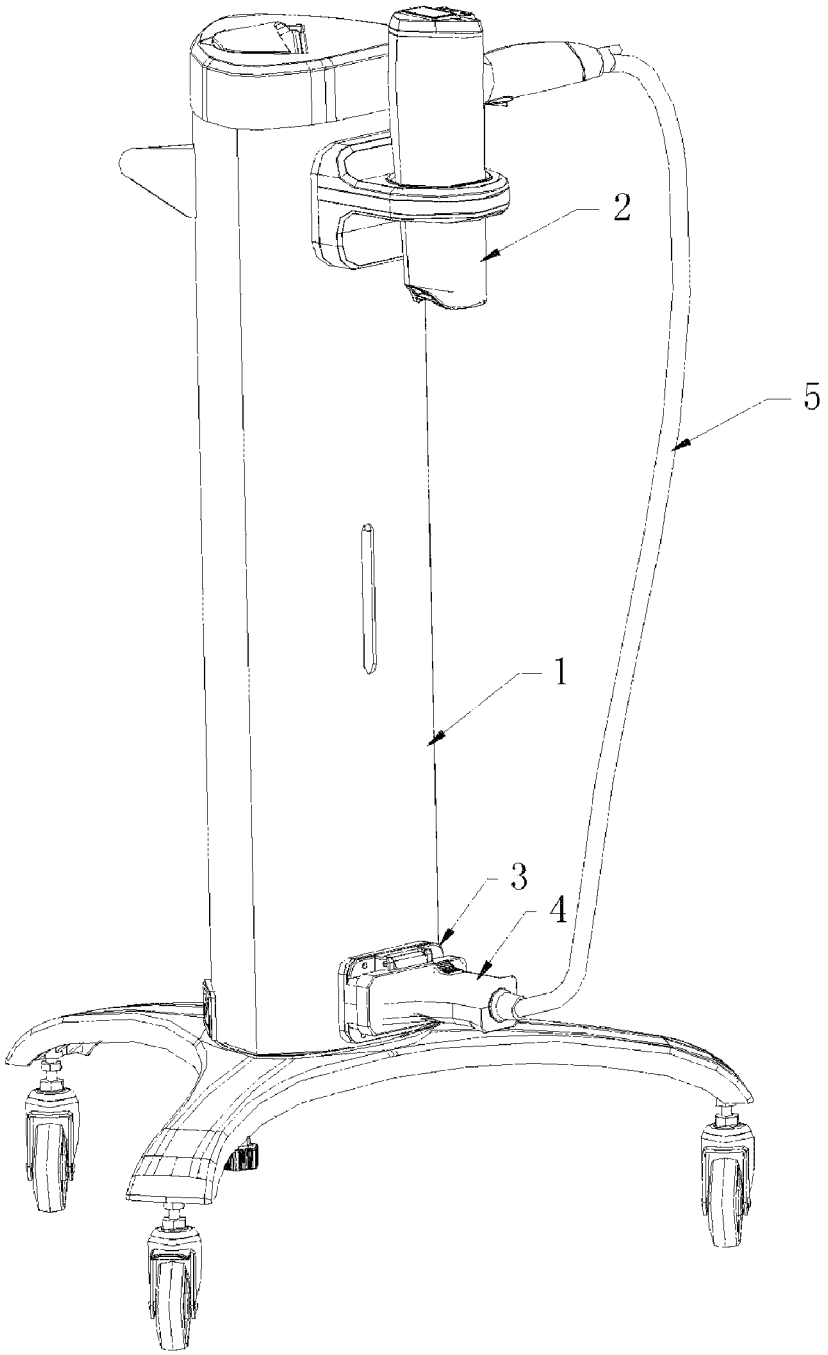
FIG. 1 is a stereo structural schematic view of a vapor beautifying and hair conditioning machine according to one embodiment of the present application.
Figure 2:
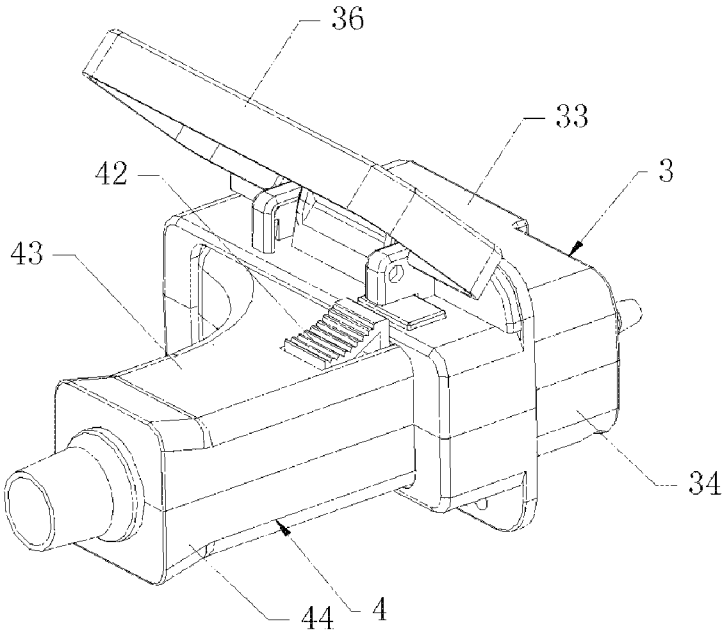
FIG. 2 is a stereo structural schematic view of the socket and the plug shown in FIG. 1, wherein the plug is inserted in the socket.
Figure 3:
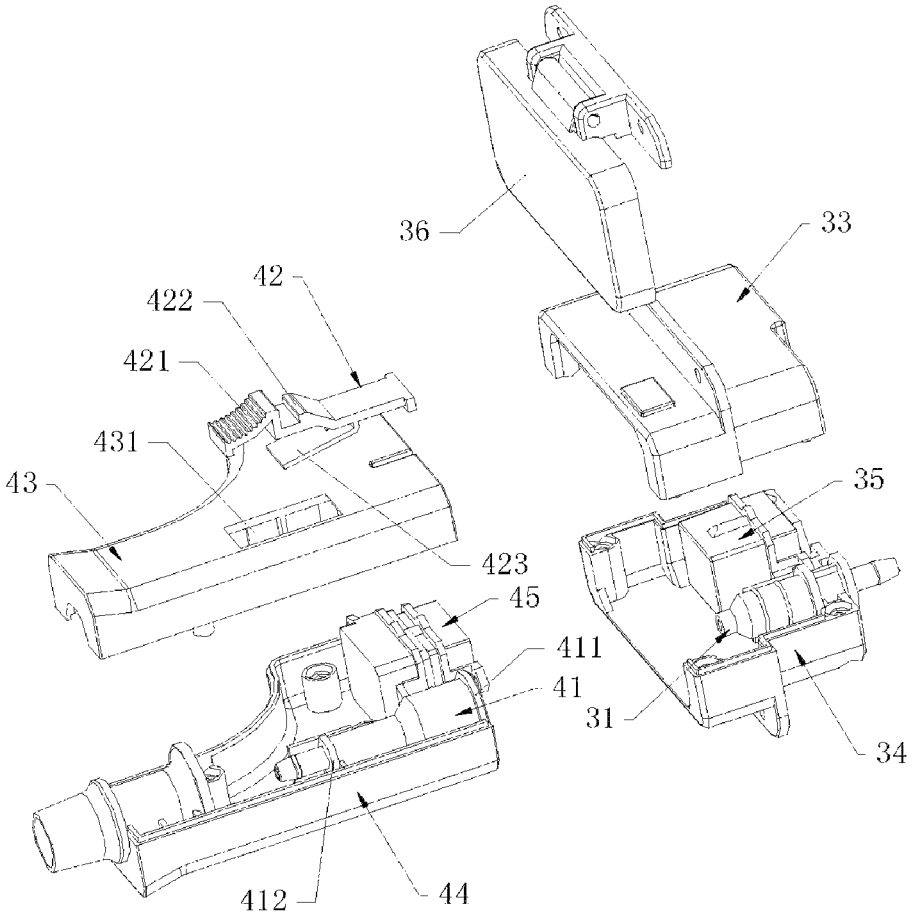
FIG. 3 is a disassembled structural schematic view of the socket and the plug shown in FIG. 2.
Figure 4:
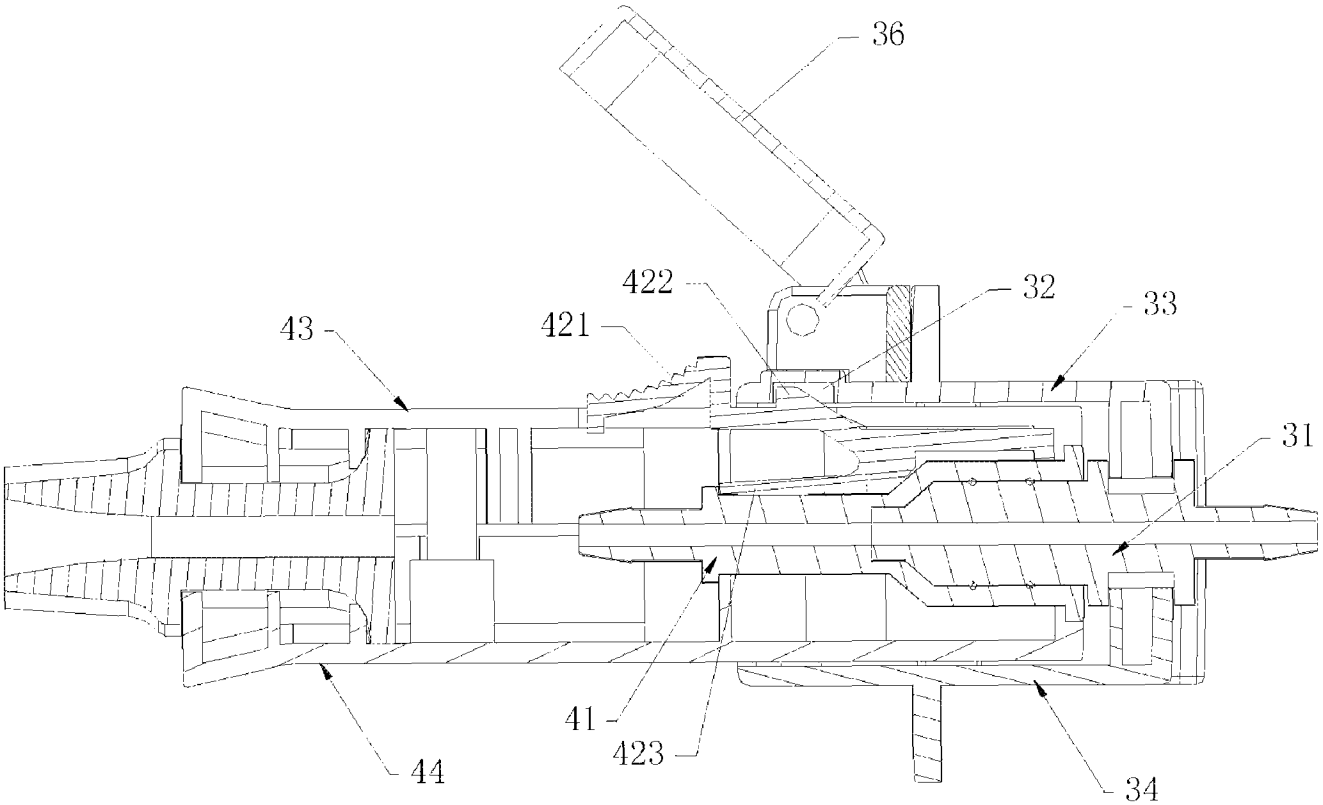
FIG. 4 is a longitudinal cut-away view of FIG. 2.

As shown in FIGS. 1-4, one preferred embodiment of the present application provides a vapor beautifying and hair conditioning machine comprising a main machine 1 and an ejection gun 2. The ejection gun 2 is communicated with the main machine 1 via a hose 5. The main machine 1 is provided with a socket 3, and one end of the hose 5 is provided with a plug 4 that is capable of being inserted in the socket 3. The socket 3 is provided therein with a hose connector male end 31 and a latching groove 32, and the plug 4 is provided therein with a hose connector female end 41 and a latching member 42. The hose connector male end 31 and the hose connector female end 41 engage with each other. When the plug 4 is inserted in the socket 3, the latching member 42 is inserted and held in the latching groove 32.

Particularly, the socket 3 further includes a top cover 33, a bottom cover 34, and a power connector male end 35. The latching groove 32 is defined in the top cover 33. The top cover 33 and the bottom cover 34 are combined together to define a containing groove (not shown), and the plug 4 can be inserted in the containing groove. The plug 4 further includes a top cover 43, a bottom cover 44, and a power connector female end 45, wherein the top cover 43 and the bottom cover 44 are combined together. The top cover 43 defines an assembling hole 431, and the latching member 42 is mounted in the assembling hole 431. The hose connector female end 41 is fixed on the bottom cover 44 of the plug 4. When the plug 4 is inserted in the socket 3, the power connector male end 35 is electrically connected with the power connector female end 45.

In this embodiment, by means of reciprocal connection or separation between the latching member 42 and the latching groove 32, detachable connection between the ejection gun 2 and the main machine 1 is realized. At the same time, the hose connector male end 31 and the hose connector female end 41 engage with each other, which ensures that water in the main machine 1 can flow into the ejection gun 2 and does not leak when the plug 4 is inserted in the socket 3. The power connector male end 35 is electrically connected with the power connector female end 45, which ensures that the ejection gun 2 can obtain electric power from the main machine 1. When the main machine 1 or the ejection gun 2 needs to be updated or upgraded independently, or when the hose 5 is wound during the use of the vapor beautifying and hair conditioning machine, the latching relation between the latching member 42 and the latching groove 32 is released, and the plug 4 is pulled out from the socket 3, so that the ejection gun 2 is separated from the main machine 1 and thus the vapor beautifying and hair conditioning machine is detached into two parts. In this way, it is convenient to update or upgrade the main machine 1 or the ejection gun 2, and is also convenient to restore the wound hose 5.

Furthermore, the latching member 42 includes a pressing part 421, a latching part 422, and a supporting part 423. The pressing part 421 protrudes out from the assembling hole 431, the latching part 422 can be inserted and held in the latching groove 32, and the supporting part 423 supports the hose connector female end 41. When the pressing part 421 is pressed, the latching part 422 moves downwards and leaves the latching groove 32; at this time, the plug 4 can be pulled out from the socket 3. When the pressing part 421 is released, the supporting part 423 rebounds upwards and restores its original shape, and the latching part 422 is inserted and held in the latching groove 32; at this time, the plug 4 cannot be pulled out from the socket 3. In order to avoid the situation that the latching member 42 deflects and is unable to restore when the pressing part 421 is pressed and the plug 4 is pulled out from the socket 3, in this embodiment, a periphery of the hose connector female end 41 is provided with a first flange 411 and a second flange 412 that are spaced from each other, an end of the latching member 42 that is away from the pressing part 421 abuts against the first flange 411, and the supporting part 423 abuts against the second flange 412.

The socket 3 further includes a protecting cover 36, the protecting cover 36 is hinged on the top cover 33 of the socket 3, and is near to the opening of the containing groove. After the plug 4 is pulled out from the socket 3, the protecting cover 36 can be closed to prevent external impurities from entering the containing groove.

What described above are only preferred embodiments of the present application, and are not intended to limit the scope of the present application; and any modifications, equivalent replacements, and improvements made within the spirit and principle of the present application should be included in the protection scope of the present application.

What is claimed is:

1. A vapor beautifying and hair conditioning machine comprising a main machine and an ejection gun; wherein, the ejection gun is communicated with the main machine via a hose, the main machine is provided with a socket, and one end of the hose is provided with a plug that is capable of being inserted in the socket; the socket is provided therein with a hose connector male end and a latching groove, the plug is provided therein with a hose connector female end and a latching member, and the hose connector male end and the hose connector female end engage with each other; when the plug is inserted in the socket, the latching member is inserted and held in the latching groove.

2. The vapor beautifying and hair conditioning machine according to claim 1, wherein, the socket is further provided therein with a power connector male end, and the plug is further provided therein with a power connector female end; when the plug is inserted in the socket, the power connector male end is electrically connected with the power connector female end.

3. The vapor beautifying and hair conditioning machine according to claim 1. wherein, the socket further includes a top cover and a bottom cover, the latching groove is defined in the top cover, the top cover and the bottom cover are combined together to define a containing groove, and the plug can be inserted in the containing groove.

4. The vapor beautifying and hair conditioning machine according to claim 3, wherein, the socket further includes a protecting cover, the protecting cover is hinged on the top cover of the socket, and is near to the opening of the containing groove.

5. The vapor beautifying and hair conditioning machine according to claim 1. wherein, the plug further includes a top cover and a bottom cover, the top cover and the bottom cover are combined together, the top cover defines an assembling hole, and the latching member is mounted in the assembling hole.

6. The vapor beautifying and hair conditioning machine according to claim 5, wherein, the hose connector female end is fixed on the bottom cover of the plug.

7. The vapor beautifying and hair conditioning machine according to claim 5, wherein, the latching member includes a pressing part, a latching part, and a supporting part; the pressing part protrudes out from the assembling hole, and the supporting part supports the hose connector female end; when the plug is inserted in the socket, the latching part is inserted and held in the latching groove; and when the plug leaves the socket, the latching part leaves the latching groove.

8. The vapor beautifying and hair conditioning machine according to claim 7, wherein, a periphery of the hose connector female end is provided with a first flange and a second flange that are spaced from each other, an end of the latching member that is away from the pressing part abuts against the first flange, and the supporting part abuts against the second flange.

* * * * *